United States Patent [19]

Wernert

[11] 4,289,207

[45] Sep. 15, 1981

[54] FIRE EXTINGUISHING SYSTEM

[75] Inventor: Gregory M. Wernert, Peoria, Ill.

[73] Assignee: Caterpillar Tractor Co., Peoria, Ill.

[21] Appl. No.: 8,981

[22] Filed: Feb. 5, 1979

[51] Int. Cl.[3] ..... A62C 11/00

[52] U.S. Cl. ..... 169/30; 73/708

[58] Field of Search ..... 169/30, 71, 9; 73/716, 73/736, 708; 116/70, 216; 239/71, 74

[56] References Cited

U.S. PATENT DOCUMENTS

| | | | |
|---|---|---|---|
| 1,629,063 | 5/1927 | Berry | 73/736 |
| 2,690,079 | 9/1954 | Morschel | 73/716 |
| 2,866,339 | 12/1958 | Rhodes et al. | 73/716 |
| 3,045,761 | 7/1962 | Ciarlo | 169/71 |
| 3,675,722 | 7/1972 | Balmes, Sr. | 169/30 |
| 3,728,899 | 4/1973 | Dijkema | 73/708 |
| 3,850,039 | 11/1974 | Brakebill | 73/716 |

*Primary Examiner*—Robert J. Spar
*Assistant Examiner*—Kenneth Noland
*Attorney, Agent, or Firm*—Wegner, Stellman, McCord, Wiles & Wood

[57] ABSTRACT

In a fire extinguishing system including a pressure vessel (10) filled with a non-solid fire extinguishing material (12) having a vapor pressure that fluctuates with temperature, a controllable outlet (14, 16, 18) for the vessel, and a pressure sensing device (20) for monitoring the pressure in the vessel, the improvement wherein the pressure sensing device includes a differential pressure sensing device (20) having two input ports (22, 24) one of the ports (22) being in fluid communication with the interior or the pressure vessel, and a sealed second vessel (26) in sufficiently close proximity to the pressure vessel so as to be exposed to the same ambient temperature as the pressure vessel and filled with fire extinguishing material (28) substantially to a desired fill density, the other of the ports (24) being in communication with the interior of the second vessel (26). The system is self compensating for widely varying temperatures which affect the pressures exerted by the fire extinguishing material (12, 28) so that an accurate indication of the charged condition of the extinguisher is provided regardless of temperature.

3 Claims, 1 Drawing Figure

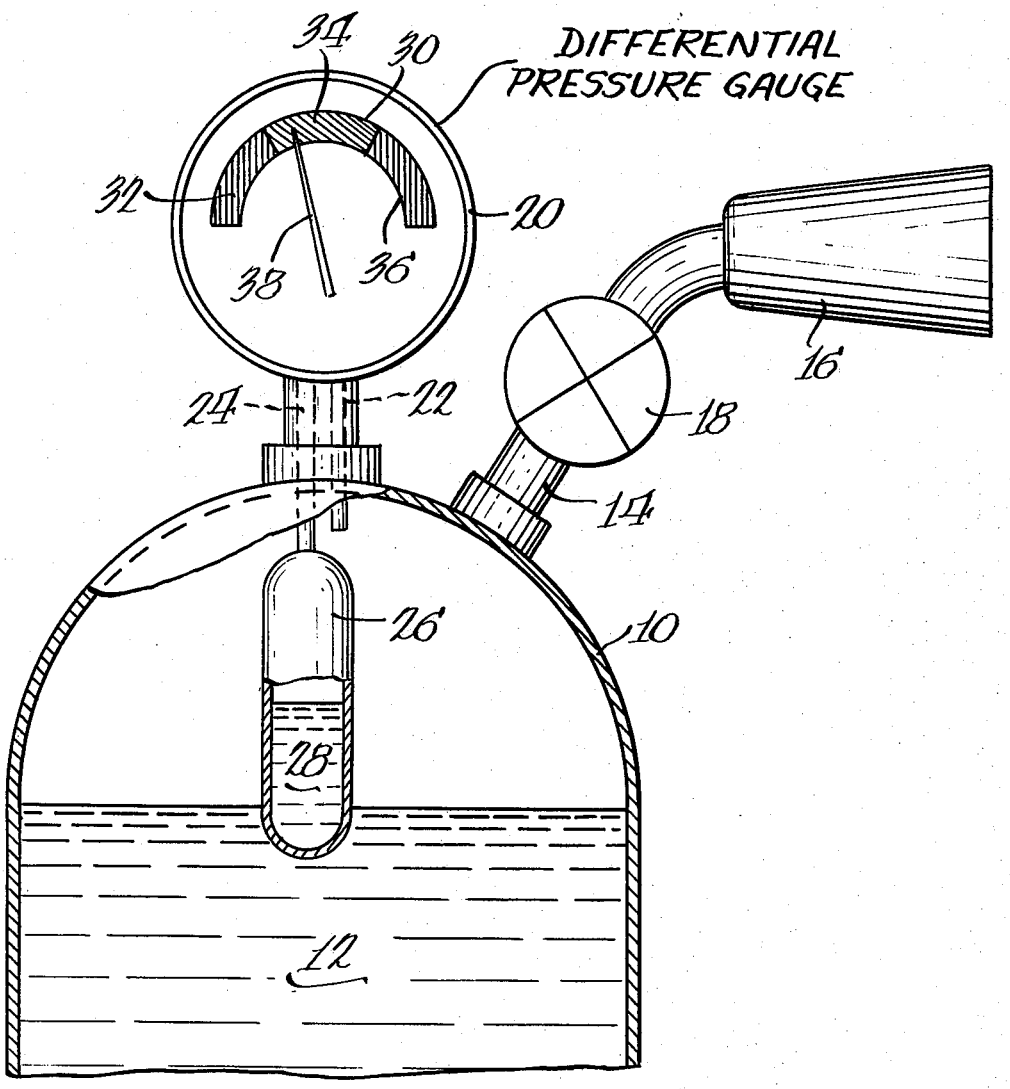
34
30
DIFFERENTIAL
PRESSURE GAUGE
32
20
38
36
16
24
22
18
14
26
10
28
12

FIRE EXTINGUISHING SYSTEM

TECHNICAL FIELD

This invention relates to fire extinguishing systems and, more particularly, to indicators in such systems whereby the charge of fire extinguishing material in the system can be readily ascertained.

BACKGROUND ART

Many fire extinguishing systems in use today utilize pressure vessels which are charged with some predetermined weight of a nonsolid fire extinguishing material. When the system outlet is opened, the fire extingusihing material is expelled therefrom under pressure.

Of course, in order to be effective, it is necessary that the system contain, at all times, some predetermined minimum quantity of the fire extinguishing material. In most locations, periodic inspections of the system are made and, at least in the case of portable fire extinguishing systems, the most accurate way of ascertaining whether the system is properly charged is simply to weigh the pressure vessel comprising the extinguisher. In the usual case, the weight of the empty pressure vessel and appurtenances thereto is stamped on the vessel along with the weight of extinguishing material the vessel is to contain. If the weight of the extinguisher does not equal or exceed the desired total, the extinguisher must be recharged in order to meet minimum requirements.

This method of checking is, as mentioned, quite accurate and most likely should be performed periodically regardless of what other measures may be utilized to ascertain whether the charge is at or above minimum requirements. However, it is time-consuming in that it requires transportation of specialized equipment to the extinguisher site to provide for accurate weighing or, in the alternative the movement of the extinguisher to the site of a suitable scale. And, in between periodic inspections there is always the possibility that leakage will occur and/or the extinguisher actually used depeleting its charge, in whole or in part, without being recharged. As a consequence, if a need for the extinguisher arises after such occurrences and before the next inspection, the charge may be insufficient with the result that a fire may not be brought satisfactorily under control.

To alleviate this problem, the prior art has proposed the use of pressure sensing devices in fluid communication with the interior of the pressure vessel for sensing either the pressure of the extinguishing material therein, the pressure of the compressed gas within the vessel utilized to drive the material from the vessel when the vessel is opened, or a combination of both. In some instances where the fire extinguishing material is of the so-called "dry chemical" type, where only a compressed gas pressure is sensed, this worked quite well. However, in other cases, where a nonsolid fire extinguishing material is utilized, and where that material has a vapor pressure that fluctuates widely with temperature, pressure sensing alone is insufficient.

For example, a fire extinguisher normally placed within, say, the engine compartment of a vehicle or a power plant, may reach a temperature of 140° F. or more because of the heat generated within its environment. But this, in turn, will result in a high pressure indication on a pressure gauge which may show to be in a fully charged range on the gauge whereas if the extinguisher were exposed to more typical ambient temperatures, say 70° F., there would be a clear indication of insufficient pressurization or charge.

To avoid the inaccuracies inherent in pure pressure indications, the prior art has also resorted to the use of pressure gauges which sense the pressure of the interior of the vessel and indicate the same on a scale in both pressure and temperature units. A person inspecting the gauge of such an extinguisher might observe, for example, an indication of 350 psig and a temperature of 70° F. If the observer believes the ambient temperature to be approximately 70° F., he can be assured that the extinguisher is properly charged. However, if at that time, he believes the ambient temperature to be 90° F., because the temperature reading on the pressure gauge is only 70° F., he may deduce that the extinguisher is undercharged.

This system represents an improvement over pure pressure readings, but is also suspect in that it requires a subjective decision on the part of the observer; he must properly estimate the ambient temperature.

Such estimates, in many cases, may be fairly reliable. However, reverting to the example of a fire extinguisher housed in the engine compartment of a vehicle, the observer has no accurate way of estimating the temperature within such a housing and may miss in his estimate by many tens of degrees F. The problem is compounded in that the usual human observer seldom encounters ambient temperatures much in excess of 100° F. and therefore will have very little experience in accurately estimating temperatures that are appreciably higher.

DISCLOSURE OF INVENTION

In one aspect of the present invention there is provided a fire extinguishing system including a pressure vessel adapted to be filled to a desired fill density with a non-solid fire extinguishing material having a vapor pressure that fluctuates with temperature. There is a controllable outlet for the vessel and a pressure sensing device for monitoring the pressure in the vessel. The invention contemplates the improvement wherein the pressure sensing device includes a differential pressure sensing device having two pressure signal inputs, one connected to the pressure vessel. A sealed second vessel is in sufficiently close proximity to the pressure vessel so as to be exposed to the same ambient temperatures as the pressure vessel and is adapted to be filled with a non-solid material whose pressure fluctuates with temperature to a fill density such that temperature-pressure characteristics thereof relatively closely follow those of the fire extinguishing material at the desired fill density. The other signal input of the differential pressure sensing device is connected to the interior of the second vessel.

The invention eliminates any need to estimate ambient temperature in the vicinity of the fire extinguisher as is the case with the most pertinent prior art. When the pressure vessel has leaked or has been partially discharged, the temperature-pressure characteristics of the fire extinguishing material will no longer follow those of the material in the second vessel. As a consequence, so long as there is no partial discharge of the contents of the pressure vessel or leakage therefrom, the pressures within the two vessels will be the same to indicate proper charging. However, upon partial discharge or leakage from the pressure vessel of fire extinguishing material or pressurized gas, a differential pressure will come into existence which may be observed from the pressure sensing device.

BRIEF DESCRIPTION OF DRAWINGS

The FIGURE is a somewhat schematic illustration of an embodiment of a fire extinguishing system made according to the invention with parts broken away for clarity.

BEST MODE FOR CARRYING OUT THE INVENTION

An exemplary embodiment of a fire extinguishing system made according to the invention is illustrated in the drawings and will be descripted hereinafter as in a portable fire extinguisher. However, it will be appreciated that the invention may be used with efficacy in any type of fire extinguishing system wherein a fire extinguishing material is maintained in a vessel and is expelled therefrom under pressure and where the fire extinguishing material has a vapor pressure that fluctuates with temperature, whether or not the system is portable.

The system includes a first pressure vessel 10 which is filled with a non-solid fire extinguishing material 12 whose vapor pressure will vary dependent upon temperature. While the fire extinguishing material 12 may be any of a large variety of types, for exemplary purposes only, it may be assumed to that type sold under the registered trademark Halon ® 1301.

The vessel includes an outlet opening (not shown) in fluid communication with a hose 14 extending to a horn 16 or other discharge equipment (not shown). A suitable valve 18 controls the flow of extinguishing material from the vessel through the hose 14 to the horn 16 which can be manipulated to direct the extinguishing material at a fire.

A differential pressure gauge 20 of conventional construction is mounted on the vessel 10 and includes first and second inlet ports 22 and 24 respectively. The inlet port 22 is in fluid communication with the interior of the pressure vessel 10 while the inlet port 24 is in fluid communication with the interior of a second vessel 26. The vessel 26 is otherwise sealed and contains a non-solid material 28 whose pressure varies with temperature. Generally, the material 28 will be the same as the fire extinguishing material 12 for convenience although this is not necessary. As will appear, it is only necessary that the material 28 exhibit certain characteristics in common with the material 12.

The gauge 20 includes a scale 30 which typically may be divided into three regions 32, 34, and 36. A moveable indicator in the form of a pointer 38 also forms part of the pressure gauge and its position is controlled by the inner workings of the gauge 20 in a conventional fashion. Typically, when the pressure at both ports 22 and 24 is identical, the needle 38 will be centered. Conversely, when the pressure in the port 22 exceeds that in the port 24, the needle 38 will tend to deflect from its central position in a clockwise direction. When the pressure in the port 24 exceeds the pressure in the port 22, deflection will occur in a counterclockwise direction.

The regions 32, 34, and 36 of the scale 30 will typically bear legends (not shown). For the type of operation of the differential pressure gauge 20 mentioned immediately preceeding, the region 32 would be provided with a legion indicating undercharging of the extinguisher. The region 36 would be provided with an indication of overcharging and the central region 34 would include an indication of a proper charge.

In the usual case, where Halon ® 1301 is used, it will exist as a liquid in both the vessel 10 and the vessel 26. A charge of an inert gas under pressure will be placed in both to some desired degree. Nitrogen is frequently used for this purpose.

The vessel 26 is so located within the vessel 10 so as to be in good heat exchange relation therewith. This is to insure that the temperature of the material 28 within the second vessel 26 will be at substantially the same temperature as that of the fire extinguishing material 12, which will usually be close or at ambient temperature.

Both vessels 10 and 26 are charged to the same fill density. That is, each has the same amount of material 12 or 28 and pressurizing gas, if any, per unit of volume. Consequently, temperature changes in the material 12 and 28 will provide identical pressure changes to the respective ports 22 and 24 so that the needle 38 will remain centered. The temperature changes will be substantially identical because of the good heat transfer relationship between the material 12 and the contents of the second vessel 26. However, should there be leakage or partial discharge of the pressure vessel 10, the fill densities will no longer be identical with the consequence that for a given temperature of the material 28 and the material 12, the pressure applied to the port 24 will exceed that applied to the port 22 causing the needle 38 to deflect in a counterclockwise direction to indicate an underfilled condition. And of course, if at the time of initial charging, the vessel 10 was overcharged, that is charged to a fill density greater than that of the second vessel 26, a greater pressure would be applied to the gauge through the port 22 than the port 24 resulting in clockwise deflection of the needle 38 to indicate an overcharge condition.

The following table exemplifies the pressure at various temperatures of a fire extinguishing pressure vessel filled with twenty-one pounds of Halon ® 1301. It is assumed that, to meet minimum requirements, the vessel must have at least fifteen pounds of Halon ® 1301 in it at all times. Thus, a loss of more than 6 pounds of Halon ® 1301 from the original fill is considered to be unacceptable, and requires recharging. Thus the following table indicates both temperature over a wide range, corresponding pressures at a fill of 21 pounds and a fill at 15 pounds (corresponding to a 6 pound leak) and the pressure difference at the corresponding temperatures.

This pressure difference can then be employed in formulating the scale 30 so as to appropriately locate the dividing line between the regions 32 and 34 at the displacement of the needle 38 from its central position corresponding to the average pressure difference over the desired temperature range. Of course, similar data can be obtained to indicate where the dividing line between the region 34 and 36 should be placed to indicate an overfilled condition.

The table is as follows:

HALON 1301
PRESSURE VS. TEMPERATURE DATE
FILL: 21 lbs (56 lb/ft$^3$)

| TEMPERATURE °F. | PRESSURE ORIGINAL FILL psig | PRESSURE 6 lb LEAK psig | Delta P psi |
|---|---|---|---|
| −40 | 142.3 | 123.7 | 18.6 |
| −30 | 153.2 | 134.0 | 19.2 |
| −20 | 165.3 | 145.6 | 19.7 |

-continued

| HALON 1301 PRESSURE VS. TEMPERATURE DATE FILL: 21 lbs (56 lb/ft$^3$) | | | |
|---|---|---|---|
| TEMPERATURE °F. | PRESSURE ORIGINAL FILL psig | PRESSURE 6 lb LEAK psig | Delta P psi |
| −10 | 179.0 | 158.6 | 20.4 |
| 0 | 194.2 | 173.2 | 21.0 |
| 10 | 211.3 | 189.6 | 21.7 |
| 20 | 230.2 | 207.8 | 22.4 |
| 30 | 251.2 | 228.1 | 23.1 |
| 40 | 274.5 | 250.5 | 24.0 |
| 50 | 300.3 | 275.4 | 24.9 |
| 60 | 328.7 | 302.8 | 25.9 |
| 70 | 360.0 | 332.9 | 27.1 |
| 80 | 394.4 | 365.9 | 28.5 |
| 90 | 432.4 | 402.1 | 30.3 |
| 100 | 474.1 | 441.8 | 35.3 |
| 110 | 420.4 | 485.1 | 35.3 |
| 120 | 572.1 | 532.4 | 39.7 |
| 130 | 631.4 | 584.4 | 47.0 |
| 140 | 706.0 | 642.3 | 63.7 |
| 150 | 743.7 | 716.9 | 26.8 |

INDUSTRIAL APPLICABILITY

From the foregoing table, it will be appreciated that a fire extinguishing system made according to the invention is ideally suited for use where it might be subjected to a wide variety of ambient temperatures, some or all of which are impossible to estimate. The charge on the extinguishing system may be easily checked at all times simply by observation of the gauge 20 by even the most unskilled observer. A ready indication of undercharging, overcharging, or optimum charging is provided over the entire range and allows the check to be accurately made without the need for weighing equipment.

And while the invention contemplates the use of the same materials in both the vessels 10 and 26 for ease of comparison purposes, it will be appreciated that the material 28 need not be identical to the material 12 if, at the fill densities of concern, it exhibits similar temperature-pressure characteristics. It will also be recognized that the vessel 26 need not be within the vessel 10 although this is desired for compactness. The vessel 26 could be outside of the vessel 10 but in sufficiently close proximity thereto as to be exposed to the same ambient temperature to provide the automatic temperature compensation featured by the system.

What is claimed is:

1. In a fire extinguishing system including a pressure vessel (10) filled to a desired fill density with a non-solid fire extinguishing material (12) having a vapor pressure that fluctuates with temperature, a controllable outlet (14,16,18) from said vessel, and a pressure sensing device (20) for monitoring the pressure in said vessel, the improvement wherein said pressure sensing device includes a differential pressure sensing device (20) having two input ports (22,24), one (22) of said ports being in fluid communication with the interior of said pressure vessel, and a sealed second vessel (26) in sufficiently close proximity to said pressure vessel so as to be exposed to the same ambient temperatures as the pressure vessel and filled with said fire extinguishing material (28) substantially to said desired fill density, the other (24) of said ports being in fluid communication with the interior of said second vessel.

2. The fire extinguishing system of claim 1 wherein said second vessel is located within said pressure vessel.

3. The fire extinguishing system of claim 1 wherein said second vessel is located within said pressure vessel so as to be in direct heat transfer relation to fire extinguishing material received in said pressure vessel.

* * * * *